US009187991B2

(12) United States Patent
Fripp et al.

(10) Patent No.: US 9,187,991 B2
(45) Date of Patent: Nov. 17, 2015

(54) DOWNHOLE FLUID FLOW CONTROL SYSTEM HAVING PRESSURE SENSITIVE AUTONOMOUS OPERATION

(71) Applicant: Halliburton Energy Services, Inc., Houston, TX (US)

(72) Inventors: Michael Linley Fripp, Carrollton, TX (US); John Charles Gano, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 381 days.

(21) Appl. No.: 13/742,723

(22) Filed: Jan. 16, 2013

(65) Prior Publication Data

US 2013/0228341 A1 Sep. 5, 2013

(30) Foreign Application Priority Data

Mar. 2, 2012 (WO) ..... PCT/US2012/027463

(51) Int. Cl.

| | |
|---|---|
| ***E21B 43/12*** | (2006.01) |
| ***E21B 43/08*** | (2006.01) |
| ***E21B 34/08*** | (2006.01) |
| ***E21B 43/14*** | (2006.01) |

(52) U.S. Cl.

CPC ..... *E21B 43/12* (2013.01); *E21B 34/08* (2013.01); *E21B 43/08* (2013.01); *E21B 43/14* (2013.01)

(58) Field of Classification Search

CPC ... E21B 2034/007; E21B 34/08; E21B 34/14; E21B 43/08; E21B 43/12

See application file for complete search history.

(56) References Cited

U.S. PATENT DOCUMENTS

| | | | | |
|---|---|---|---|---|
| 4,340,088 | A | 7/1982 | Geisow | |
| 5,697,449 | A | 12/1997 | Hennig et al. | |
| 6,176,311 | B1 | 1/2001 | Ryan | |
| 6,371,210 | B1 * | 4/2002 | Bode et al. | 166/370 |
| 6,899,176 | B2 * | 5/2005 | Hailey et al. | 166/278 |
| 7,055,598 | B2 | 6/2006 | Ross et al. | |
| 7,096,945 | B2 * | 8/2006 | Richards et al. | 166/276 |
| 7,296,633 | B2 * | 11/2007 | Bode et al. | 166/386 |
| 7,909,088 | B2 * | 3/2011 | O'Malley et al. | 166/53 |
| 7,918,275 | B2 * | 4/2011 | Clem | 166/250.15 |
| 7,987,909 | B2 * | 8/2011 | Pineda et al. | 166/278 |
| 8,230,935 | B2 * | 7/2012 | Gano et al. | 166/386 |
| 8,550,166 | B2 * | 10/2013 | Xu et al. | 166/326 |
| 8,752,629 | B2 * | 6/2014 | Moen | 166/321 |
| 8,757,273 | B2 * | 6/2014 | Themig et al. | 166/373 |
| 2002/0108755 | A1 | 8/2002 | Zisk, Jr. | |
| 2003/0141061 | A1 * | 7/2003 | Hailey et al. | 166/278 |

(Continued)

OTHER PUBLICATIONS

International Search Report and Written Opinion, PCT/2012/027465, KIPO, Mar. 2, 2012.

(Continued)

*Primary Examiner* — Jennifer H Gay

(57) ABSTRACT

A downhole fluid flow control system is operable to be positioned in a wellbore in a fluid flow path between a formation and an internal passageway of a tubular. The system includes a flow control component positioned in the fluid flow path that is operable to control fluid flow therethrough. The system also includes a pressure sensitive valve positioned in the fluid flow path in parallel with the flow control component. The valve autonomously shifts from a first position to a second position responsive to a change in a pressure signal received by the valve, thereby enabling fluid flow therethrough.

22 Claims, 7 Drawing Sheets

(56) References Cited

U.S. PATENT DOCUMENTS

| | | | | |
|---|---|---|---|---|
| 2004/0020832 | A1* | 2/2004 | Richards et al. | 210/106 |
| 2004/0035578 | A1* | 2/2004 | Ross et al. | 166/250.15 |
| 2006/0131033 | A1* | 6/2006 | Bode et al. | 166/386 |
| 2008/0149323 | A1* | 6/2008 | O'Malley et al. | 166/53 |
| 2008/0283238 | A1* | 11/2008 | Richards et al. | 166/228 |
| 2009/0133869 | A1* | 5/2009 | Clem | 166/250.15 |
| 2009/0151925 | A1* | 6/2009 | Richards et al. | 166/53 |
| 2011/0017470 | A1* | 1/2011 | Xu et al. | 166/373 |
| 2011/0083860 | A1* | 4/2011 | Gano et al. | 166/386 |
| 2011/0100643 | A1* | 5/2011 | Themig et al. | 166/373 |
| 2011/0186300 | A1 | 8/2011 | Dykstra et al. | |
| 2011/0198097 | A1* | 8/2011 | Moen | 166/373 |
| 2012/0048561 | A1* | 3/2012 | Holderman | 166/316 |
| 2012/0255741 | A1* | 10/2012 | Stewart | 166/374 |
| 2013/0048299 | A1* | 2/2013 | Fripp et al. | 166/373 |
| 2013/0056221 | A1* | 3/2013 | Johannessen | 166/373 |
| 2013/0220632 | A1* | 8/2013 | Greci et al. | 166/373 |
| 2013/0228341 | A1* | 9/2013 | Fripp et al. | 166/373 |
| 2013/0276901 | A1* | 10/2013 | Holderman | 137/12 |
| 2013/0277059 | A1* | 10/2013 | Holderman et al. | 166/319 |
| 2014/0034308 | A1* | 2/2014 | Holderman et al. | 166/279 |
| 2015/0021019 | A1* | 1/2015 | Veit | 166/250.15 |

OTHER PUBLICATIONS

Australian Government IP Australia, Patent Examination Report No. 1, May 20, 2015, 6 pages.

* cited by examiner

DOWNHOLE FLUID FLOW CONTROL SYSTEM HAVING PRESSURE SENSITIVE AUTONOMOUS OPERATION

CROSS-REFERENCE TO RELATED APPLICATIONS

This application claims the benefit under 35 U.S.C. §119 of the filing date of International Application No. PCT/US2012/027463, filed Mar. 2, 2012. The entire disclosure of this prior application is incorporated herein by this reference.

TECHNICAL FIELD OF THE INVENTION

This invention relates, in general, to equipment utilized in conjunction with operations performed in subterranean wells and, in particular, to a downhole fluid flow control system and method utilizing pressure sensitive autonomous operation to control fluid flow therethrough.

BACKGROUND OF THE INVENTION

Without limiting the scope of the present invention, its background will be described with reference to producing fluid from a hydrocarbon bearing subterranean formation, as an example. During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screen assemblies positioned proximate the desired production interval or intervals. In other completions, to control the flowrate of production fluids into the production tubing, it is common practice to install one or more flow control devices within the tubing string.

Attempts have been made to utilize fluid flow control devices within completions requiring sand control. For example, in certain sand control screen assemblies, after production fluids flow through the filter medium, the fluids are directed into a flow control section. The flow control section may include one or more flow control components such as flow tubes, nozzles, labyrinths or the like. Typically, the production flow resistance through these flow control screens is fixed prior to installation by the number and design of the flow control components.

It has been found, however, that due to changes in formation pressure and changes in formation fluid composition over the life of the well, it may be desirable to adjust the flow control characteristics of the flow control sections. In addition, for certain completions, it would be desirable to adjust the flow control characteristics of the flow control sections without the requirement for well intervention.

Accordingly, a need has arisen for a downhole fluid flow control system that is operable to control the inflow of formation fluids. In addition, a need has arisen for such a downhole fluid flow control system that may be incorporated into a flow control screen. Further, a need has arisen for such downhole fluid flow control system that is operable to adjust its flow control characteristics without the requirement for well intervention as the production profile of the well changes over time.

SUMMARY OF THE INVENTION

The present invention disclosed herein comprises a downhole fluid flow control system for controlling the inflow of formation fluids. In addition, the downhole fluid flow control system of the present invention is operable to be incorporated into a flow control screen. Further, the downhole fluid flow control system of the present is operable to adjust its flow control characteristics without the requirement for well intervention as the production profile of the well changes over time.

In one aspect, the present invention is directed to a downhole fluid flow control system operable to be positioned in a wellbore in a fluid flow path between a formation and an internal passageway of a tubular. The system includes a flow control component positioned in the fluid flow path that is operable to control fluid flow therethrough. A pressure sensitive valve is positioned in the fluid flow path in parallel with the flow control component. The valve autonomously shifts from a first position to a second position responsive to a change in a pressure signal received by the valve, thereby enabling fluid flow therethrough.

In one embodiment, the flow control component is an inflow control device. In another embodiment, the flow control component has directional dependent flow resistance. In other embodiments, the pressure sensitive valve includes a sliding sleeve. In such embodiments, the pressure sensitive valve may include a biasing constituent such as a mechanical spring or a fluid spring that biases the sliding sleeve in opposition to at least one component of the pressure signal. The pressure signal may be borehole pressure generated by formation fluid, tubing pressure or a combination thereof in the form of differential pressure therebetween.

In another aspect, the present invention is directed to a flow control screen that is operable to be positioned in a wellbore. The flow control screen includes a base pipe with an internal passageway. A filter medium is positioned around the base pipe. A housing is positioned around the base pipe defining a fluid flow path between the filter medium and the internal passageway. At least one flow control component is disposed within the fluid flow path and is operable to control fluid flow therethrough. A pressure sensitive valve is disposed within the fluid flow path in parallel with the at least one flow control component. The valve autonomously shifts from a first position to a second position responsive to a change in a pressure signal received by the valve, thereby enabling fluid flow therethrough.

In a further aspect, the present invention is directed downhole tool operable to be positioned in a wellbore in a fluid flow path between a formation and an internal passageway of a tubular. The tool includes a pressure sensitive valve operable to autonomously shift from a first position to a second position responsive to a change in a pressure signal received by the valve, wherein at least one component of the pressure signal is borehole pressure generated by formation fluid.

In yet another aspect, the present invention is directed to a downhole fluid flow control method. The method includes providing a fluid flow control system having a flow control component and a pressure sensitive valve in parallel with one another; positioning the fluid flow control system in a wellbore such that the flow control component and the pressure sensitive valve are disposed in a fluid flow path between a formation and an internal passageway of a tubular; producing formation fluid through the flow control component; maintaining the pressure sensitive valve in a first position responsive to a pressure signal received by the valve, wherein at least one component of pressure signal is borehole pressure generated by formation fluid; autonomously shifting the pressure sensitive valve from the first position to a second position responsive to a change in the pressure signal; and producing formation fluid through the pressure sensitive valve.

The method may also include maintaining the pressure sensitive valve in the closed position responsive to the pressure signal; biasing the pressure sensitive valve toward the open position with a mechanical spring or a fluid spring; autonomously shifting the pressure sensitive valve from the closed position to the open position responsive to a decrease in borehole pressure and/or autonomously shifting the pressure sensitive valve from the closed position to the open position responsive to a change in tubing pressure.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
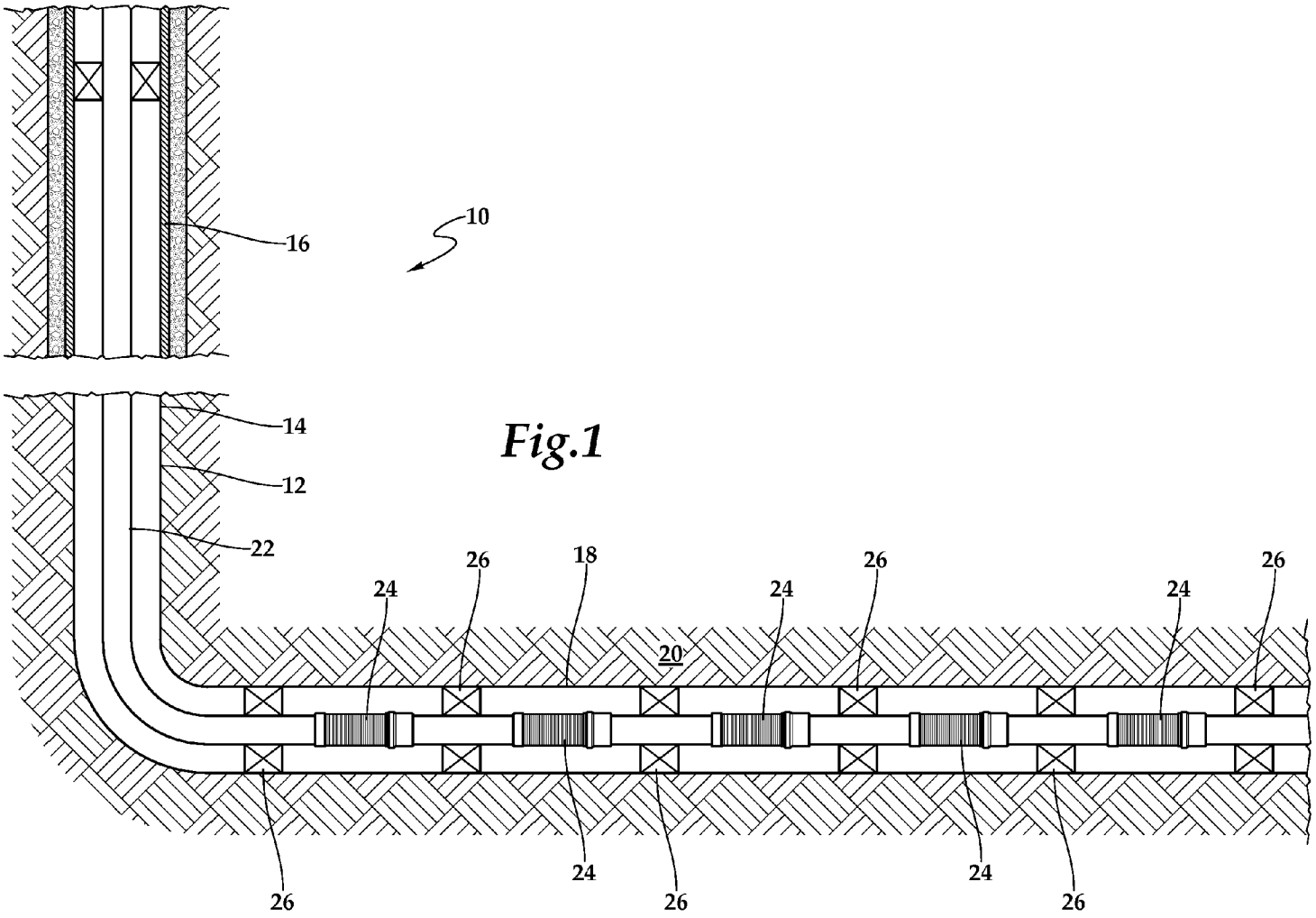
FIG. 1 is a schematic illustration of a well system operating a plurality of downhole fluid flow control systems according to an embodiment of the present invention.

Referring initially to FIG. 1, therein is depicted a well system including a plurality of downhole fluid flow control systems positioned in flow control screens embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and for injection fluids to travel from the surface to formation 20. At its lower end, tubing string 22 is coupled to a completions string that has been installed in wellbore 12 and divides the completion interval into various production intervals adjacent to formation 20. The completion string includes a plurality of flow control screens 24, each of which is positioned between a pair of annular barriers depicted as packers 26 that provides a fluid seal between the completion string and wellbore 12, thereby defining the production intervals. In the illustrated embodiment, flow control screens 24 serve the function of filtering particulate matter out of the production fluid stream. Each flow control screen 24 also has a flow control section that is operable to control fluid flow therethrough. For example, the flow control sections may be operable to control flow of a production fluid stream during the production phase of well operations. Alternatively or additionally, the flow control sections may be operable to control the flow of an injection fluid stream during a treatment phase of well operations. As explained in greater detail below, the flow control sections are operable to control the inflow of production fluids without the requirement for well intervention over the life of the well as the formation pressure decreases to maximize production of a desired fluid such as oil.

Even though FIG. 1 depicts the flow control screens of the present invention in an open hole environment, it should be understood by those skilled in the art that the present invention is equally well suited for use in cased wells. Also, even though FIG. 1 depicts one flow control screen in each production interval, it should be understood by those skilled in the art that any number of flow control screens of the present invention may be deployed within a production interval or within a completion interval that does not include production intervals without departing from the principles of the present invention. In addition, even though FIG. 1 depicts the flow control screens of the present invention in a horizontal section of the wellbore, it should be understood by those skilled in the art that the present invention is equally well suited for use in wells having other directional configurations including vertical wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Further, even though FIG. 1 depicts the flow control components in a flow control section of a flow control screen, it should be understood by those skilled in the art that the flow control components of the present invention need not be associated with a flow control screen or be part of a completion string, for example, the flow control components may be operably disposed within a drill string for drill stem testing.

Figure 2A:
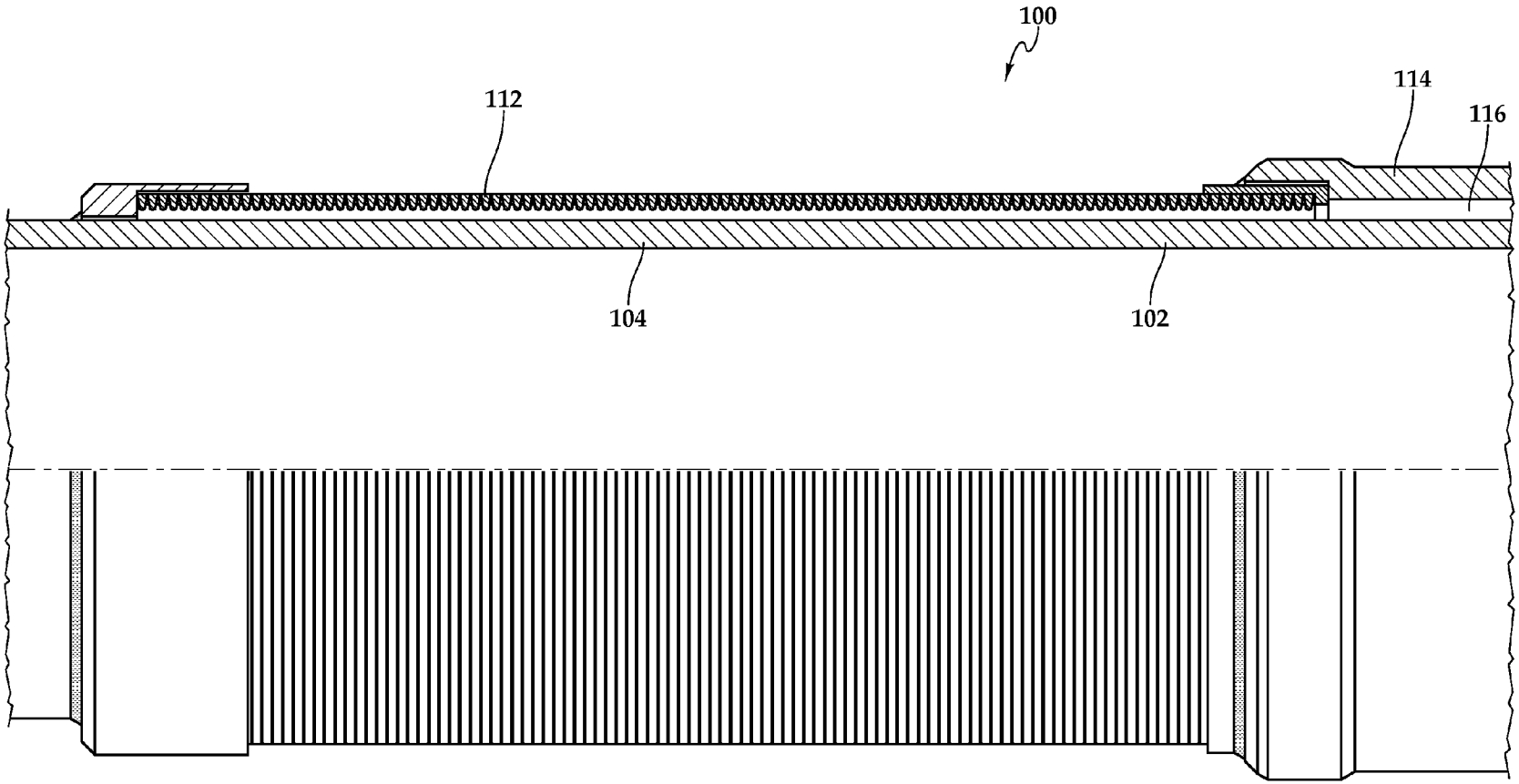
FIGS. 2A-2B are quarter sectional views of successive axial sections of a downhole fluid flow control system embodied in a flow control screen of the present invention in a first production configuration.
Figure 2B:
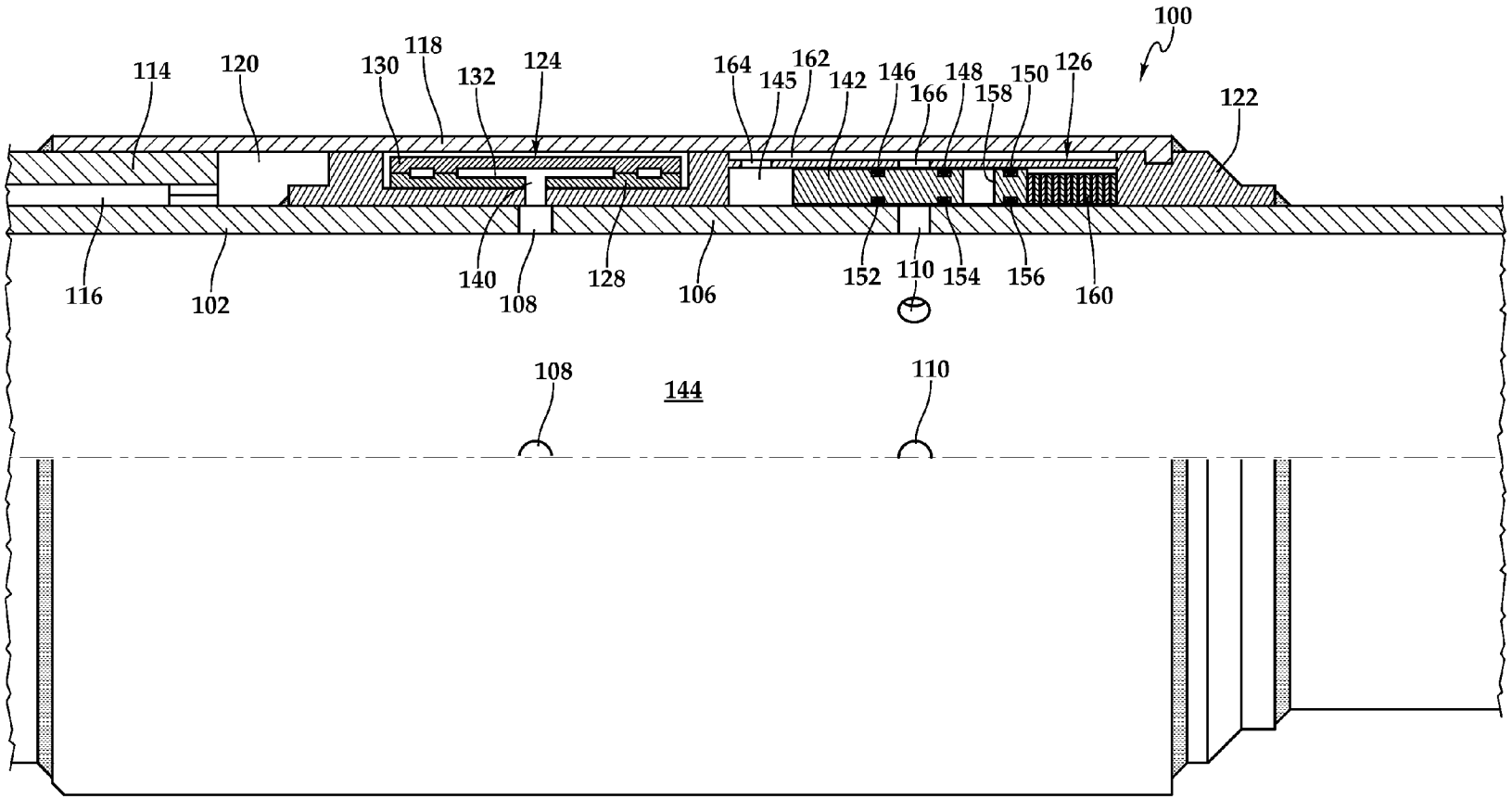

Referring next to FIGS. 2A-2B, therein is depicted successive axial sections of a flow control screen according to the present invention that is representatively illustrated and generally designated 100. Flow control screen 100 may be suitably coupled to other similar flow control screens, production packers, locating nipples, production tubulars or other downhole tools to form a completions string as described above. Flow control screen 100 includes a base pipe 102 that has a blank pipe section 104 and a perforated section 106 including a plurality of production ports 108 and a plurality of bypass ports 110. Positioned around an uphole portion of blank pipe section 104 is a screen element or filter medium 112, such as a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those skilled in the art that the present invention does not need to have a filter medium associated therewith, accordingly, the exact design of the filter medium is not critical to the present invention.

Positioned downhole of filter medium 112 is a screen interface housing 114 that forms an annulus 116 with base pipe 102. Securably connected to the downhole end of screen interface housing 114 is a flow control housing 118 that forms an annulus 120 with base pipe 102. At its downhole end, flow control housing 118 is securably connected to a support assembly 122 which is securably coupled to base pipe 102. The various connections of the components of flow control screen 100 may be made in any suitable fashion including welding, threading and the like as well as through the use of fasteners such as pins, set screws and the like.

Figure 3:
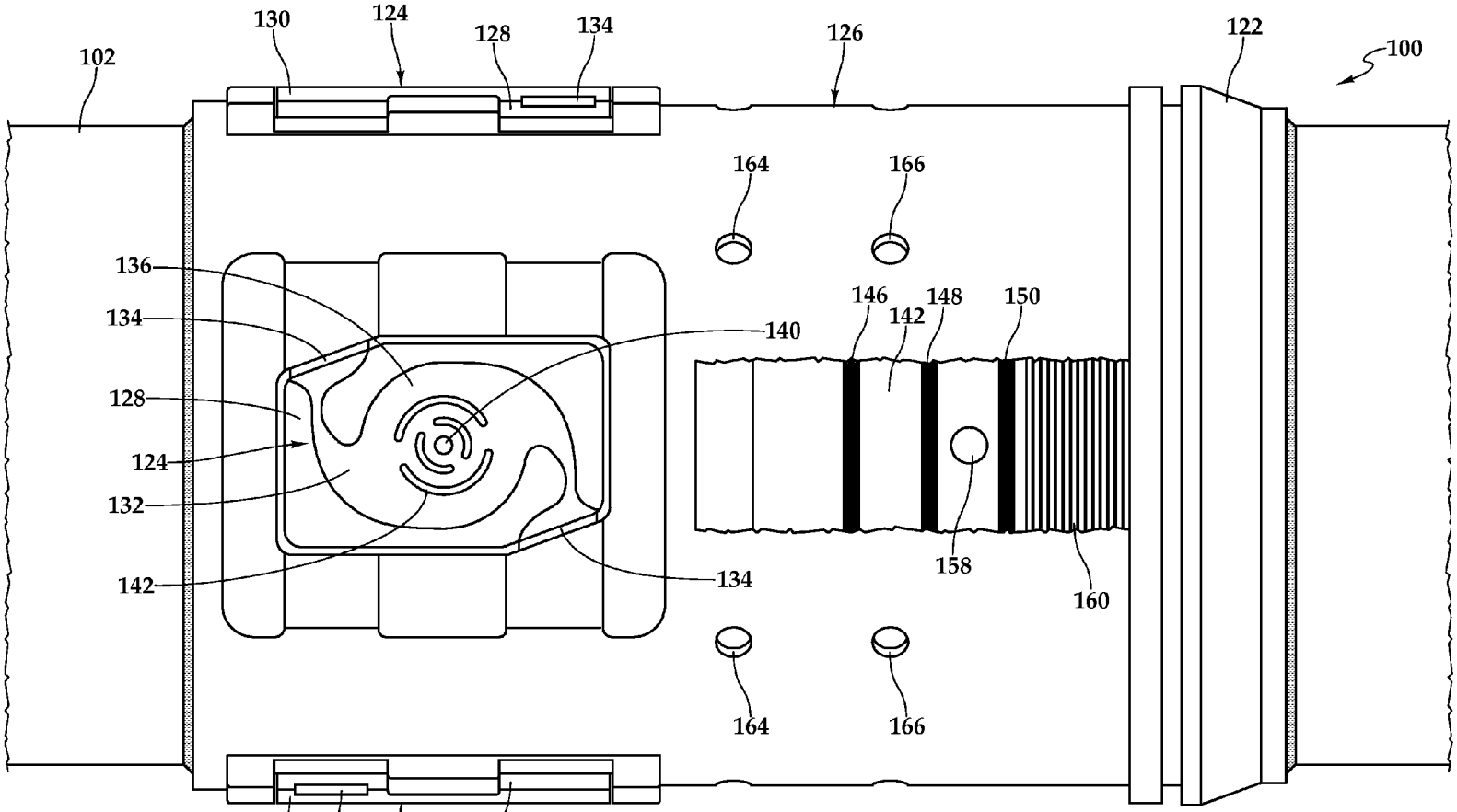
FIG. 3 is a top view, partially in cut away, of a flow control section of a downhole fluid flow control system according to an embodiment of the present invention with an outer housing removed.

Positioned within flow control housing 118, flow control screen 100 has a flow control section including a plurality of flow control components 124 and a bypass section 126. In the illustrated embodiment, flow control components 124 are circumferentially distributed about base pipe 102 at one hundred and twenty degree intervals such that three flow control components 124 are provided, as best seen in FIG. 3 wherein flow control housing 118 has been removed. Even though a particular arrangement of flow control components 124 has been described, it should be understood by those skilled in the art that other numbers and arrangements of flow control components 124 may be used. For example, either a greater or lesser number of circumferentially distributed flow control components 124 at uniform or nonuniform intervals may be used. Additionally or alternatively, flow control components 124 may be longitudinally distributed along base pipe 102. As illustrated, flow control components 124 are each formed from an inner flow control element 128 and an outer flow control element 130, the outer flow control element being removed from one of the flow control components 124 in FIG. 3 to aid in the description of the present invention. Flow control components 124 each have a fluid flow path 132 including a pair of fluid ports 134, a vortex chamber 136 and a port 140. In addition, flow control components 124 have a plurality of fluid guides 142 in vortex chambers 136.

Flow control components 124 may be operable to control the flow of fluid in either direction therethrough and may have directional dependent flow resistance wherein production fluids may experience a greater pressure drop when passing through flow control components 124 than do injection fluids. For example, during the treatment phase of well operations, a treatment fluid may be pumped downhole from the surface in the interior passageway 144 of base pipe 102 (see FIG. 2A-2B). The treatment fluid then enters the flow control components 124 through ports 140 and passes through vortex chambers 136 where the desired flow resistance is applied to the fluid flow achieving the desired pressure drop and flowrate therethrough. In the illustrated example, the treatment fluids entering vortex chamber 136 primarily travel in a radial direction within vortex chamber 136 before exiting through fluid ports 134 with little spiraling within vortex chamber 136 and without experiencing the associated frictional and centrifugal losses. Consequently, injection fluids passing through flow control components 124 encounter little resistance and pass therethrough relatively unimpeded enabling a much higher flowrate with significantly less pressure drop than in a production scenario. The fluid then travels into annular region 120 between base pipe 102 and flow control housing 118 before entering annulus 116 and passing through filter medium 112 for injection into the surrounding formation.

Likewise, during the production phase of well operations, fluid flows from the formation into the production tubing through fluid flow control system 100. The production fluid, after being filtered by filter medium 112, if present, flows into annulus 116. The fluid then travels into annular region 120 between base pipe 102 and flow control housing 118 before entering the flow control section. The fluid then enters fluid ports 134 of flow control components 124 and passes through vortex chambers 136 where the desired flow resistance is applied to the fluid flow achieving the desired pressure drop and flowrate therethrough. In the illustrated example, the production fluids entering vortex chamber 136 travel primarily in a tangentially direction and will spiral around vortex chamber 136 with the aid of fluid guides 142 before eventually exiting through ports 140. Fluid spiraling around vortex chamber 136 will suffer from frictional losses. Further, the tangential velocity produces centrifugal force that impedes radial flow. Consequently, production fluids passing through flow control components 124 encounter significant resistance. Thereafter, the fluid is discharged through openings 108 to the interior passageway 144 of base pipe 102 for production to the surface. Even though a particular flow control components 124 has been depicted and described, those skilled in the art will recognize that other flow control components having alternate designs may be used without departing from the principles of the present invention including, but not limited to, inflow control devices, fluidic devices, venturi devices, fluid diodes and the like.

In the illustrated embodiment, bypass section 126 includes a piston depicted as an annular sliding sleeve 142 that is slidably and sealingly positioned in an annular region 145 between support assembly 122 and base pipe 102. As illustrated, sliding sleeve 142 includes three outer seals 146, 148, 150 that sealingly engage an interior surface of support assembly 122 and three inner seals 152, 154, 156 that sealingly engage an exterior surface of base pipe 102. Sliding sleeve 142 also includes one or more bypass ports 158 that extend radially through sliding sleeve 142. Bypass ports 158 may be circumferentially distributed around sliding sleeve 142 and may be circumferentially aligned with one or more of bypass ports 110 of base pipe 102. Bypass ports 158 are positioned between outer seals 148, 150 and between inner seals 154, 156. Also disposed within annular region 145 is a mechanical biasing element depicted as a wave spring 160. Even though a particular mechanical biasing element is depicted, those skilled in the art will recognize that other mechanical biasing elements such as a spiral would compression spring may alternatively be used with departing from the principles of the present invention. Support assembly 122 forms an annulus 162 with flow control housing 118. Support assembly 122 includes a plurality of operating ports 164 that may be circumferentially distributed around support assembly 122 and a plurality of bypass ports 166 that may be circumferentially distributed around support assembly 122 and may be circumferentially aligned with bypass ports 158 of sliding sleeve 142.

Figure 4:
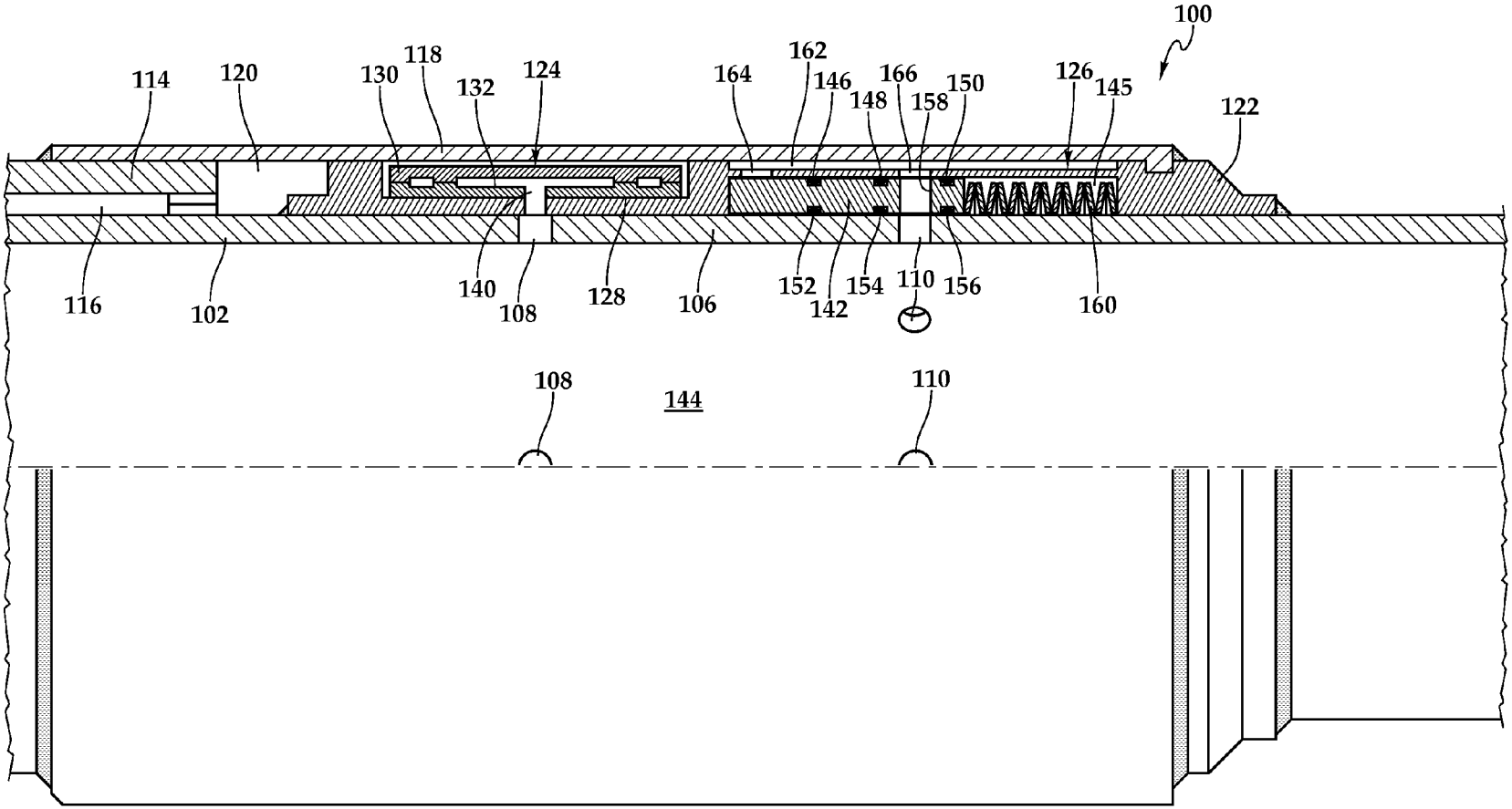
FIG. 4 is a quarter sectional view of an axial section of a downhole fluid flow control system embodied in a flow control screen of the present invention in a second production configuration.

The operation of bypass section 126 will now be described. Early in the life of the well, formation fluids enter the wellbore at the various production intervals at a relatively high pressure. As described above, flow control components 124 are used to control the pressure and flowrate of the fluids entering the completion string. At the same time, the fluid pressure from the borehole surrounding flow control screen 100 generated by formation fluids enters annulus 162 and pass through operating ports 164 to provide a pressure signal that acts on sliding sleeve 142 and compresses spring 160, as best seen in FIG. 2B. In this operating configuration, bypass ports 158 of sliding sleeve 142 are not in fluid communication with bypass ports 166 of support assembly 122 or bypass ports 110 of base pipe 102. This is considered to be the valve closed position of sliding sleeve 142, which prevents production fluid flow therethrough. As long as the formation pressure (also referred to herein as annulus pressure) is sufficient to overcome the bias force of spring 160, sliding sleeve 142 will remain in the valve closed position. As the well ages, however, the formation pressure will decline which results in a change in the pressure signal that acts on sliding sleeve 142. When the formation pressure reached a predetermined level, wherein the pressure signal is no longer sufficient to overcome the bias force of spring 160, sliding sleeve 142 will autonomously shift from the valve closed position to the valve open position, as best seen in FIG. 4. In this operating configuration, bypass ports 158 of sliding sleeve 142 are in fluid communication with bypass ports 166 of support assembly 122 and bypass ports 110 of base pipe 102. Formation fluids will now flow from the annulus surrounding flow control screen 100 to the interior 144 of flow control screen 100 predominantly through bypass section 126. In this configuration, the resistance to flow is significantly reduced as the formation fluids will substantially bypass the high resistance through flow control components 124. In this manner, the flow control characteristics of flow control screen 100 can be autonomously adjusted to enable enhanced production due to a reduction in the pressure drop experience by the formation fluids entering the completion string.

Figure 5:
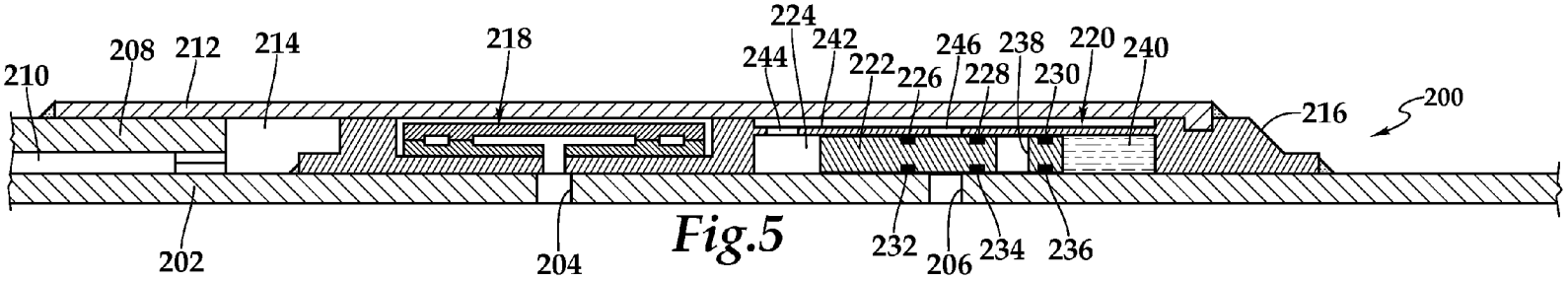
FIG. 5 is a cross sectional view of a flow control section of a downhole fluid flow control system according to an embodiment of the present invention.

Referring next to FIG. 5, therein is depicted a flow control section of a downhole fluid flow control system according to an embodiment of the present invention that is generally designated 200. The illustrated flow control section 200 includes base pipe 202 having production ports 204 and bypass ports 206. A screen interface housing 208 forms an annulus 210 with base pipe 202. Securably connected to the downhole end of screen interface housing 208 is a flow control housing 212 that forms an annulus 214 with base pipe 202. At its downhole end, flow control housing 212 is securably connected to a support assembly 216 which is securably coupled to base pipe 202. Flow control section 200 also includes a plurality of flow control components 218, the operation of which may be similar to that of flow control components 124 described above. In addition, flow control section 200 includes a bypass section 220.

Similar to bypass section 126 described above, bypass section 220 includes a piston depicted as an annular sliding sleeve 222 that is slidably and sealingly positioned in an annular region 224 between support assembly 216 and base pipe 202. As illustrated, sliding sleeve 222 includes three outer seals 226, 228, 230 that sealingly engage an interior surface of support assembly 216 and three inner seals 232, 234, 236 that sealingly engage an exterior surface of base pipe 202. Sliding sleeve 222 also includes one or more bypass ports 238 that extend radially through sliding sleeve 222. Bypass ports 238 may be circumferentially distributed around sliding sleeve 222 and may be circumferentially aligned with one or more of bypass ports 206 of base pipe 202. Bypass ports 238 are positioned between outer seals 228, 230 and between inner seals 234, 236. Also disposed within annular region 224 is a biasing element depicted as a fluid spring 240 that contains a compressible fluid such as nitrogen, air or the like. Support assembly 216 forms an annulus 242 with flow control housing 212. Support assembly 216 includes a plurality of operating ports 244 that may be circumferentially distributed around support assembly 216 and a plurality of bypass ports 246 that may be circumferentially distributed around support assembly 216 and may be circumferentially aligned with bypass ports 238 of sliding sleeve 222.

The operation of bypass section 220 will now be described. As discussed above, early in the life of the well, formation fluids enter the wellbore at the various production intervals at a relatively high pressure such that flow control components 218 are used to control the pressure and flowrate of the fluids entering the completion string. At the same time, the formation fluids enter annulus 242 and pass through operating ports 244 to provide a pressure signal that acts on sliding sleeve 222 and compresses fluid spring 240 such that bypass ports 238 of sliding sleeve 222 are not in fluid communication with bypass ports 246 of support assembly 216 or bypass ports 206 of base pipe 202 placing bypass section 220 in the valve closed position, as best seen in FIG. 5. As long as the formation pressure is sufficient to overcome the bias force of fluid spring 240, sliding sleeve 222 will remain in the valve closed position, however, as the formation pressure declines over time and reaches a predetermined level, wherein the pressure signal is no longer able to overcome the bias force of spring 240, sliding sleeve 222 will autonomously shift to the left, in the illustrated embodiment, from the valve closed position to the valve open position enabling fluid flow through bypass section 220 via bypass ports 246, 238, 206, which are in fluid communication with one another. In this configuration, the resistance to flow is significantly reduced as the formation fluids will substantially bypass the high resistance through flow control components 218, thereby enhancing production due to a reduction in the pressure drop experience by the formation fluids entering the completion string.

Figure 6:
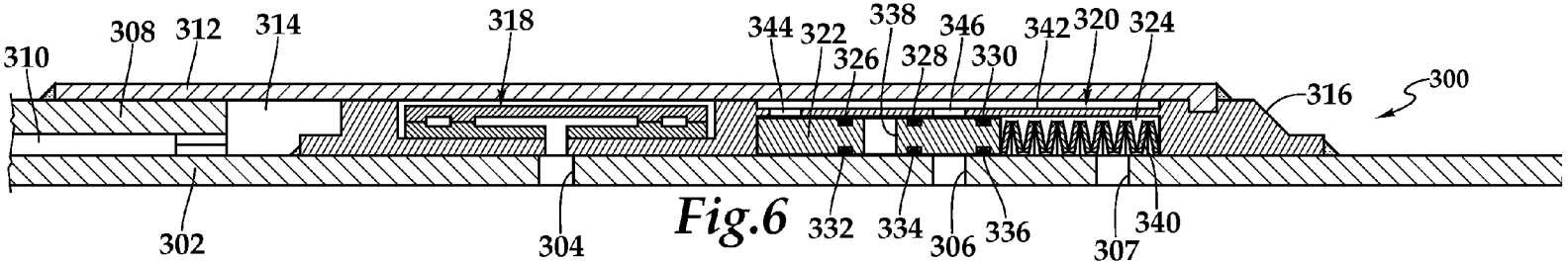
FIG. 6 is a cross sectional view of a flow control section of a downhole fluid flow control system according to an embodiment of the present invention.

Referring next to FIG. 6, therein is depicted a flow control section of a downhole fluid flow control system according to an embodiment of the present invention that is generally designated 300. The illustrated flow control section 300 includes base pipe 302 having production ports 304, bypass ports 306 and operating ports 307. A screen interface housing 308 forms an annulus 310 with base pipe 302. Securably connected to the downhole end of screen interface housing 308 is a flow control housing 312 that forms an annulus 314 with base pipe 302. At its downhole end, flow control housing 312 is securably connected to a support assembly 316 which is securably coupled to base pipe 302. Flow control section 300 also includes a plurality of flow control components 318, the operation of which may be similar to that of flow control components 124 described above. In addition, flow control section 300 includes a bypass section 320.

Similar to bypass section 126 described above, bypass section 320 includes a piston depicted as an annular sliding sleeve 322 that is slidably and sealingly positioned in an annular region 324 between support assembly 316 and base pipe 302. As illustrated, sliding sleeve 322 includes three outer seals 326, 328, 330 that sealingly engage an interior surface of support assembly 316 and three inner seals 332, 334, 336 that sealingly engage an exterior surface of base pipe 302. Sliding sleeve 322 also includes one or more bypass ports 338 that extend radially through sliding sleeve 322. Bypass ports 338 may be circumferentially distributed around sliding sleeve 322 and may be circumferentially aligned with one or more of bypass ports 306 of base pipe 302. Bypass ports 338 are positioned between outer seals 326, 328 and between inner seals 332, 334. Also disposed within annular region 324 is a biasing element depicted as a wave spring 340. Support assembly 316 forms an annulus 342 with flow control housing 312. Support assembly 316 includes a plurality of operating ports 344 that may be circumferentially distributed around support assembly 316 and a plurality of bypass ports 346 that may be circumferentially distributed around support assembly 316 and may be circumferentially aligned with bypass ports 338 of sliding sleeve 322.

The operation of bypass section 320 will now be described. Unlike the bypass sections discussed above wherein the pressure signal received by the sliding sleeve was an absolute pressure signal from the annulus surrounding the downhole fluid flow control system, in the present embodiment, the pressure signal is a differential pressure signal, one component of which is annulus pressure via operating ports 344 and the other component of which is tubing pressure via operating ports 307. In the illustrated embodiment, in order to operate sliding sleeve 322 from the closed position, as depicted in FIG. 6, to the open position, the differential between the annulus pressure and the tubing pressure must be sufficient to overcome the spring bias force. In other words, the annulus pressure signal component must be sufficient to overcome the combination of the spring bias force and the tubing pressure signal component. In one implementation, the spring bias force is selected such that under the expecting pressure and flow regimes in the annulus and the tubing, sliding sleeve 322 is in the closed position during standard production operations. If the tubing pressure signal component drops below a predetermined level, however, sliding sleeve 322 will automatically shift to the open position. The reduction in the tubing pressure signal component may take place autonomously as the well changes over time or may take place due to operator action. In the case of the later, the operator may, for example, open a choke valve at the surface to over produce the well which in turn lowers the bottom hole pressure in the well and increases the differential pressure across bypass section 320. This change in the pressure signal acting on sliding sleeve 322 may operate sliding sleeve from the closed position to the open position.

In wells having multiple flow control system, such as that described in FIG. 1, generating a change in the pressure signal by over producing the well will tend to operate all of the flow control system in the well. The operator may alternatively want to shift only certain of the flow control systems. This can be achieved using, for example, a coil tubing system that is operable to inject a lighter fluid into the well at a desired position to create a localized reduction in the tubing pressure signal component seen by one or more flow control systems. For example, injecting a nitrogen bubble into a producing or nonproducing well would create a localized reduction in the tubing pressure signal component from the point of injection and uphole thereof as the nitrogen bubble travels uphole. Thus, flow control systems at the location of injection and uphole thereof would sequentially experience a localized reduction in the tubing pressure signal component. This change in the pressure signal acting on sliding sleeves 322 may operate sliding sleeve from the closed position to the open position. Alternatively, the coiled tubing may be used to pump or suction fluid out of the well which would also result in a localized reduction in the tubing pressure signal component in a producing well or a global reduction in the tubing pressure signal component in a nonproducing or shut in well. In either case, the change in the pressure signal acting on sliding sleeves 322 may operate sliding sleeve from the closed position to the open position.

Figure 7:
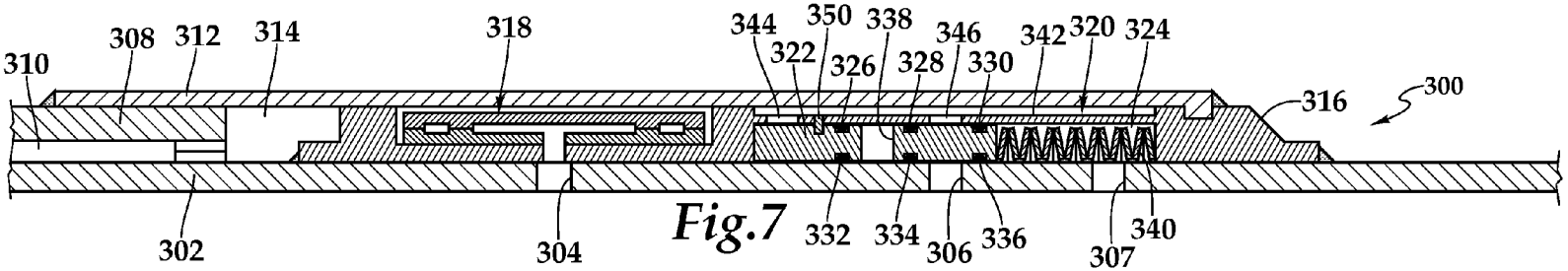
FIG. 7 is a cross sectional view of a flow control section of a downhole fluid flow control system according to an embodiment of the present invention.

Even though the change in the pressure signal has been described as causing a valve to operate from the closed position to the open position, it should be understood by those skilled in the art that a change in the pressure signal could alternatively cause the valve to operate from the open position to the closed position. For example, once a localized tubing pressure reduction has passed or once the over production operation has ended, the pressure signal acting on sliding sleeve 322 will again change and, in the illustrated embodiment, will result in sliding sleeve 322 returning to the closed position shown in FIG. 6. In addition, it may be desirable to ensure that sliding sleeve 322 does not shift from a first position to a second position until a predetermined time. To control the first operation of sliding sleeve 322, one or more locking elements depicted as frangible elements 350 such as shear pins, shear screws or the like may be used to initially couple sliding sleeve 322 to support assembly 316, as best seen in FIG. 7. In this embodiment, in order to enable sliding sleeve 322 to shift between open and closed positions, the absolute pressure acting on sliding sleeve 322 must first be raised to a sufficient level to shear frangible elements 350. The absolute pressure necessary to shear frangible elements 350 may be achieved by either raising or lower the tubing pressure depending upon the exact configuration of bypass section 320. Even though the locking elements have been depicted and described as frangible elements 350, other types of locking elements could alternatively be used including, but not limited to, collet assemblies, detents assemblies or other mechanical assemblies without departing from the principles of the present invention.

Figures 8, 9, 10, 11:
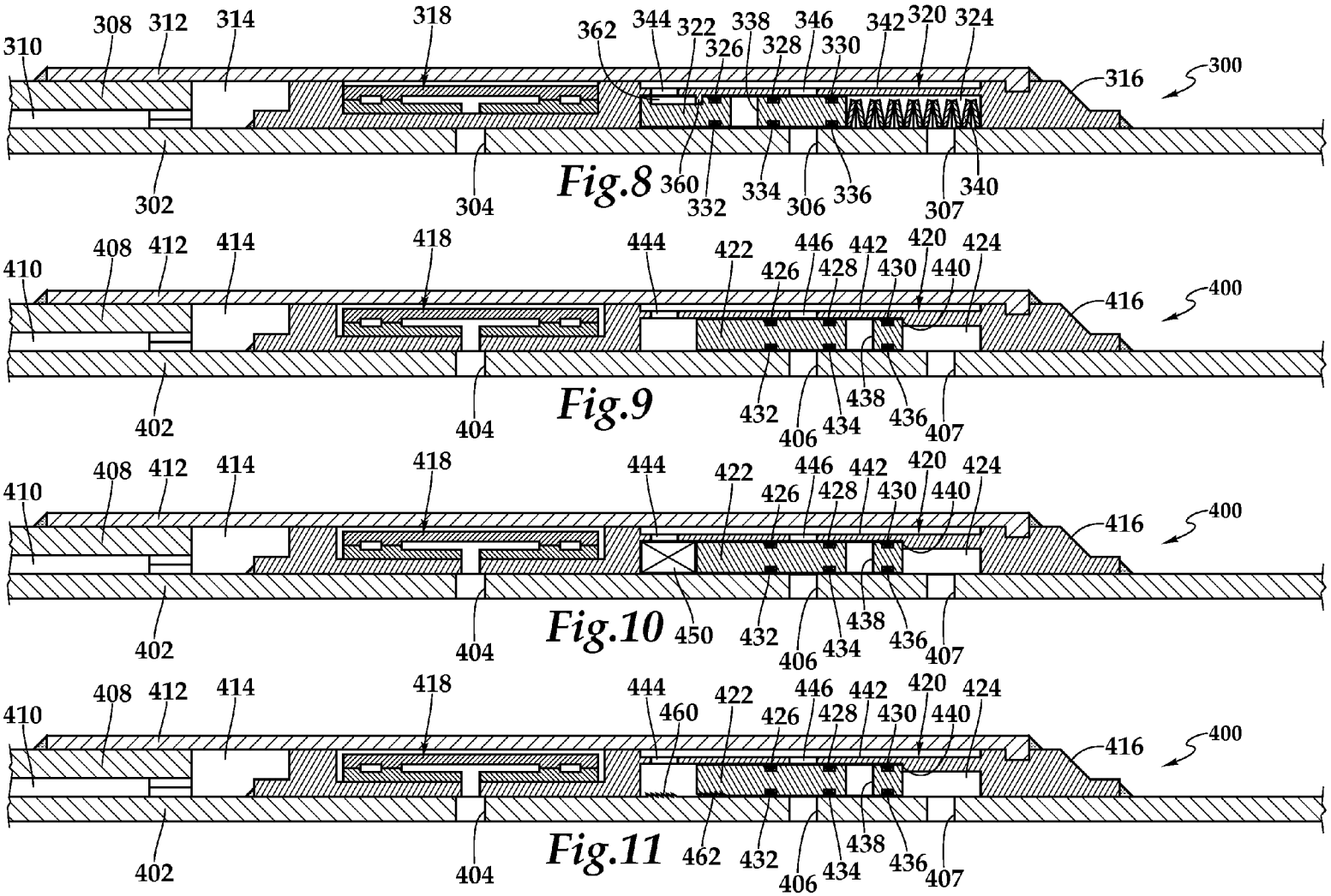
FIG. 8 is a cross sectional view of a flow control section of a downhole fluid flow control system according to an embodiment of the present invention.
FIG. 9 is a cross sectional view of a flow control section of a downhole fluid flow control system according to an embodiment of the present invention.
FIG. 10 is a cross sectional view of a flow control section of a downhole fluid flow control system according to an embodiment of the present invention.
FIG. 11 is a cross sectional view of a flow control section of a downhole fluid flow control system according to an embodiment of the present invention.

In addition to shifting a valve between open and closed positions, changes in the pressure signal may be used to cycle a sliding sleeve through a plurality of positions or an infinite series of positions. As best seen in FIG. 8, support assembly 316 may include one or more pins 360 that extend into a J-slot 362 on the exterior of sliding sleeve 322. In this embodiment, changes in the pressure signal acting on sliding sleeve 332 that cause sliding sleeve 332 to shift longitudinally relative to support assembly 316 and base pipe 302 also cause pin 360 to slide within J-slot 362. Depending upon the design of J-slot 362, the movement of pin 360 therein may cause sliding sleeve 332 to rotate or may limit the longitudinal travel of sliding sleeve 332 when pin 360 travels within certain sections of J-slot 362. For example, it may be desirable to require multiple pressure signal variation to shift sliding sleeve 332 from the closed position to the open position. In this case, pin 360 may have to travel through several sections of J-slot 362 before sliding sleeve 332 is allowed to longitudinally shift to the open position. Alternatively or additionally, J-slot 362 may be used to prevent further shifting of sliding sleeve 332 once sliding sleeve is placed in a particular position such as the open position, i.e., locking sliding sleeve in the open position. In addition, J-slot 362 may enable sliding sleeve to be configured in various choking positions between the closed position and the fully open position.

Referring next to FIG. 9, therein is depicted a flow control section of a downhole fluid flow control system according to an embodiment of the present invention that is generally designated 400. The illustrated flow control section 400 includes base pipe 402 having production ports 404, bypass ports 406 and operating ports 407. A screen interface housing 408 forms an annulus 410 with base pipe 402. Securably connected to the downhole end of screen interface housing 408 is a flow control housing 412 that forms an annulus 414 with base pipe 402. At its downhole end, flow control housing 412 is securably connected to a support assembly 416 which is securably coupled to base pipe 402. Flow control section 400 also includes a plurality of flow control components 418, the operation of which may be similar to that of flow control components 124 described above. In addition, flow control section 400 includes a bypass section 420.

Similar to bypass section 126 described above, bypass section 420 includes a piston depicted as an annular sliding sleeve 422 that is slidably and sealingly positioned in an annular region 424 between support assembly 416 and base pipe 402. As illustrated, sliding sleeve 422 includes three outer seals 426, 428, 430 that sealingly engage an interior surface of support assembly 416 and three inner seals 432, 434, 436 that sealingly engage an exterior surface of base pipe 402. Sliding sleeve 422 also includes one or more bypass ports 438 that extend radially through sliding sleeve 422. Bypass ports 438 may be circumferentially distributed around sliding sleeve 422 and may be circumferentially aligned with one or more of bypass ports 406 of base pipe 402. Bypass ports 438 are positioned between outer seals 428, 430 and between inner seals 434, 436. Support assembly 416 includes a shoulder 440 and forms an annulus 442 with flow control housing 412. Support assembly 416 includes a plurality of operating ports 444 that may be circumferentially distributed around support assembly 416 and a plurality of bypass ports 446 that may be circumferentially distributed around support assembly 416 and may be circumferentially aligned with bypass ports 438 of sliding sleeve 422.

The operation of bypass section 420 will now be described. Unlike the bypass sections discussed above wherein the pressure signal acts against a biasing member, in the present embodiment, the pressure signal provides all the energy required to move the sliding sleeve in both longitudinal directions. In this embodiment, the pressure signal has two components, the annulus pressure component via operating ports 444 and the tubing pressure component via operating ports 407. In order to operate sliding sleeve 422 from the closed position, as depicted in FIG. 9, to the open position, there must be a positive differential between the tubing pressure and the annulus pressure. In order to operate sliding sleeve 422 from the open position to the closed position, there must be a positive differential between the annulus pressure and the tubing pressure. This embodiment is particularly beneficial during the treatment phase of well operations or other injection phase of well operations in that the treatment fluid shifts sliding sleeve 422 to the open position and is able to bypass flow control components 418, thereby enabling the formation to see a greater flowrate and pressure during the treatment operation. Once production begins, sliding sleeve 422 shift from the open position to the closed position as the annulus pressure will exceed the tubing pressure.

It may be desirable to ensure that sliding sleeve 422 does not shift from a first position to a second position until a predetermined time. To control the first operation of sliding sleeve 422, a time delay mechanism 450 such as a degradable polymer element, a sacrificial element or similar element may be used to initially prevent movement of sliding sleeve 422, as best seen in FIG. 10. In this embodiment, in order to enable sliding sleeve 422 to shift between open and closed positions, time delay mechanism 450 must be removed. For example, a fluid such as water or an acid in the wellbore or heat in the wellbore may be used to melt or dissolve the material of time delay mechanism 450. In addition to controlling the initial movement of sliding sleeve 422, it may be desirable to prevent movement of sliding sleeve 422 after its initial movement. For example, once sliding sleeve 422 has been shifted from the valve closed position to the valve open position, it may be desirable to prevent sliding sleeve 422 to return to the valve closed position. As best seen in FIG. 11, base pipe 402 includes teeth 460 and sliding sleeve 422 includes mating teeth 462 that cooperate to prevent movement of sliding sleeve 422 toward the valve closed position once sliding sleeve 422 has been shifted to the valve open position. Even though a particular type of locking member has been described and depicted in FIG. 11, those skilled in the art will recognize that other types of locking members such as snap rings, spring loaded detents and the like could alternatively be used without departing from the principle of the present invention.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A downhole fluid flow control system operable to be positioned in a wellbore in a fluid flow path between a formation and an internal passageway of a tubular, the system comprising:

a flow control component positioned in the fluid flow path operable to control fluid flow therethrough; and a pressure sensitive valve positioned in the fluid flow path in parallel with the flow control component, the valve autonomously shifting in response to a change in a pressure signal received by the valve from a shut first position in which no fluid flows through said valve to an open second position so as to enable fluid flow through said valve.

2. The flow control system as recited in claim 1 wherein the flow control component further comprises an inflow control device.

3. The flow control system as recited in claim 1 wherein the flow control component has directional dependent flow resistance.

4. The flow control system as recited in claim 1 wherein the pressure sensitive valve further comprises a sliding sleeve.

5. The flow control system as recited in claim 4 wherein the pressure sensitive valve further comprises a biasing constituent that biases the sliding sleeve in opposition to at least one component of the pressure signal.

6. The flow control system as recited in claim 1 wherein the pressure signal further comprises borehole pressure generated by formation fluid.

7. The flow control system as recited in claim 1 wherein the pressure signal further comprises tubing pressure.

8. The flow control system as recited in claim 1 wherein the pressure signal further comprises differential pressure between borehole pressure generated by formation fluid and tubing pressure.

9. A flow control screen operable to be positioned in a wellbore, the screen comprising:

a base pipe with an internal passageway;

a filter medium positioned around the base pipe;

a housing positioned around the base pipe defining a fluid flow path between the filter medium and the internal passageway;

at least one flow control component disposed within the fluid flow path operable to control fluid flow therethrough; and a pressure sensitive valve disposed within the fluid flow path in parallel with the at least one flow control component, the valve autonomously shifting in response to a change in a pressure signal received by the valve from a shut first position in which no fluid flows through said valve to an open second position so as to enable fluid flow through said valve.

10. The flow control screen as recited in claim 9 wherein the at least one flow control component further comprises an inflow control device having directional dependent flow resistance.

11. The flow control screen as recited in claim 9 wherein the pressure sensitive valve further comprises a sliding sleeve and a biasing constituent that biases the sliding sleeve in opposition to at least one component of the pressure signal.

12. The flow control screen as recited in claim 11 wherein the biasing constituent is selected from the group consisting of a mechanical spring and a fluid spring.

13. The flow control screen as recited in claim 9 wherein the pressure signal further comprises borehole pressure generated by formation fluid.

14. The flow control screen as recited in claim 9 wherein the pressure signal further comprises tubing pressure.

15. The flow control screen as recited in claim 9 wherein the pressure signal further comprises differential pressure between borehole pressure generated by formation fluid and tubing pressure.

16. A downhole fluid flow control method comprising:

providing a fluid flow control system having a flow control component and a pressure sensitive valve in parallel with one another;

positioning the fluid flow control system in a wellbore such that the flow control component and the pressure sensitive valve are disposed in a fluid flow path between a formation and an internal passageway of a tubular;

producing formation fluid through the flow control component;

maintaining the pressure sensitive valve in a shut first position responsive to a pressure signal received by the valve, wherein at least one component of pressure signal is borehole pressure generated by formation fluid;

autonomously shifting the pressure sensitive valve from the first position to an open second position responsive to a change in the pressure signal; and producing formation fluid through the pressure sensitive valve.

17. The method as recited in claim 16 wherein maintaining the pressure sensitive valve in the first position responsive to the pressure signal pressure further comprises maintaining the pressure sensitive valve in the closed position responsive to the pressure signal.

18. The method as recited in claim 16 wherein maintaining the pressure sensitive valve in the first position responsive to the pressure signal further comprises biasing the pressure sensitive valve toward an open position with a spring.

19. The method as recited in claim 18 wherein biasing the pressure sensitive valve further comprises biasing the pressure sensitive valve with a mechanical spring.

20. The method as recited in claim 18 wherein biasing the pressure sensitive valve further comprises biasing the pressure sensitive valve with a fluid spring.

21. The method as recited in claim 16 wherein autonomously shifting the pressure sensitive valve from the first position to the second position responsive to a change in the pressure signal further comprises autonomously shifting the pressure sensitive valve from a closed position to an open position responsive to a decrease in borehole pressure.

22. The method as recited in claim 16 wherein autonomously shifting the pressure sensitive valve from the first position to the second position responsive to a change in the pressure signal further comprises autonomously shifting the pressure sensitive valve from a closed position to an open position responsive to a change in tubing pressure.

* * * * *